US005894188A

United States Patent [19]

Chakvorty et al.

[11] Patent Number: 5,894,188

[45] Date of Patent: Apr. 13, 1999

[54] DUAL-LAYER METAL FOR FLAT PANEL DISPLAY

[75] Inventors: Kishore K. Chakvorty; Swayambu Ramani, both of San Jose, Calif.

[73] Assignee: Candescent Technologies Corporation, San Jose, Calif.

[21] Appl. No.: 08/932,318

[22] Filed: Sep. 17, 1997

[51] Int. Cl.[6] ..... H01J 1/02

[52] U.S. Cl. ..... 313/309; 313/336; 313/351

[58] Field of Search ..... 313/309, 310, 313/336, 351, 495

[56] References Cited

U.S. PATENT DOCUMENTS 5,587,623 12/1996 Jones ..... 313/309

*Primary Examiner*—Vip Patel

*Attorney, Agent, or Firm*—Wagner, Murabito&Hao

[57] ABSTRACT

A flat panel display and a method for forming a flat panel display. In one embodiment, the flat panel display includes a cathodic structure which is formed within an active area on a backplate. The cathodic structure includes a row metal composed of strips of aluminum overlain by a layer of cladding material. The use of aluminum and cladding material to form row metal gives row metal segments which are highly conductive due to the high conductivity of aluminum. By using a suitable cladding material and processing steps, a bond between the aluminum and the cladding material is formed which has good electrical conductivity. In one embodiment, tantalum is used as a cladding material. Tantalum forms a bond with the overlying resistive layer which has good electrical conductivity. Thus, the resulting structure has very high electrical conductivity through the aluminum layer and high conductivity into the resistive layer.

9 Claims, 14 Drawing Sheets

100

201

401

DUAL-LAYER METAL FOR FLAT PANEL DISPLAY

TECHNICAL FIELD

The present claimed invention relates to the field of flat panel displays. More specifically, the present claimed invention relates to a flat panel display and methods for forming a flat panel display having row metal which provides good conductivity and which resists damage in subsequent process steps.

BACKGROUND ART

A Cathode Ray Tube (CRT) display generally provides the best brightness, highest contrast, best color quality and largest viewing angle of prior art computer displays. CRT displays typically use a layer of phosphor which is deposited on a thin glass faceplate. These CRTs generate a picture by using one to three electron beams which generate high energy electrons that are scanned across the phosphor in a raster pattern. The phosphor converts the electron energy into visible light so as to form the desired picture. However, prior art CRT displays are large and bulky due to the large vacuum envelopes that enclose the cathode and extend from the cathode to the faceplate of the display. Therefore, typically, other types of display technologies such as active matrix liquid crystal display, plasma display and electroluminescent display technologies have been used in the past to form flat panel displays.

Recently, a thin flat panel display commonly referred to as a field emission display (FED) has been developed which uses the same process for generating pictures as is used in CRT devices. These FEDs use a backplate including a matrix structure of rows and columns of electrodes. One such FED is described in U.S. Pat. No. 5,541,473 which is incorporated herein by reference. Typically, the backplate is formed by depositing a cathode structure (electron emitting) on a glass plate. The cathode structure includes emitters that generate electrons. The backplate typically has an active area surface within which the cathode structure is deposited. Typically, the active area surface does not cover the entire surface of the glass plate and a thin strip is left around the edges of the glass plate. The thin strip is referred to as a border or a border region. Conductive traces extend through the border to allow for electrical connectivity to the active area surface. These traces are typically covered by a dielectric film as they extend across the border so as to prevent shorting.

Prior art flat panel displays include a thin glass faceplate (anode) having a layer of phosphor deposited over the surface of the faceplate. A conductive layer is deposited on the glass or on the phosphor. The faceplate is typically separated from the backplate by about 1 millimeter. The faceplate includes an active area surface within which the layer of phosphor is deposited. The faceplate also includes a border region. The border is a thin strip that extends from the active area surface to the edges of the glass plate. The faceplate is attached to the backplate using a glass sealing structure. This sealing structure is typically formed by melting a glass frit in a high temperature heating step. This forms an enclosure which is pumped out so as to produce a vacuum between the active area surface of the backplate and the active area surface of the faceplate.

Prior art cathodic structures are typically formed by depositing a first layer of metal over a glass plate (first metal layer). This first metal layer is then masked and etched so as to form rows of conductive strips (row metal). Typically, a resistive layer formed of silicon carbide (SiC), cermet, or a combination of SiC and cermet is deposited over the row metal. A dielectric layer is then deposited. A second layer of metal is then deposited over the surface of the cathodic structure. A series of mask and etch steps are then performed so as to form a columns of conductive strips (column metal). The mask and etch steps also form openings in the column metal which extend through the dielectric layer so as to expose portions of the resistive layer. Emitters are formed over the exposed portions of the row metal and within the openings in the column metal by a series of deposition and etch steps. Individual regions of the cathode are selectively activated by applying electrical current to selected conductive strips of row metal and selected conductive strips of column metal so as to generate electrons which strike the phosphor so as to generate a display within the active area surface of the faceplate. These FEDs have all of the advantages of conventional CRTs but have the great advantage of being much thinner.

The first metal layer of a FED is typically formed of an alloy of nickel (approx. 92%) and vanadium (approx. 8%). A nickel vanadium alloy is used since it gives a good electrical bond with the overlying resistive layer and because it is resistant to damage and contamination in subsequent process steps. However, the resistivity of the nickel vanadium layer is approximately 55 micro-ohms-centimeter. This high resistivity causes signal delay. Signal delay causes decreased performance and inconsistent display quality. In addition, nickel vanadium alloy is expensive.

In an attempt to overcome the problems associated with the use of nickel vanadium alloy in row metal formation, manufacturers have attempted to use less resistive materials such as aluminum. However, many of these less resistive materials unfortunately do not meet process compatibility requirements. In addition, many of these less resistive materials typically do not form a sufficient electrical contact with the overlying resistive layer to function effectively. This is primarily due to the native oxide that forms on the surface of the conductive layer inhibiting current flow. In addition, subsequent process steps damage and contaminate the surface of the aluminum. In particular, the alkaline and acidic solutions used in subsequent process steps attacks aluminum. Moreover, subsequent rinsing and cleaning steps may leave deposits which adhere to the surface of the aluminum. These contaminants further degrade the quality of electrical contact between the row metal and the resistor.

One of the reasons that aluminum forms a poor electrical bond with the overlying resistive layer is oxidation of the surface of the aluminum. This oxidation results from exposure to atmospheric conditions. Prior art methods have attempted to get a good electrical bond between the Aluminum and the overlying resistive layer by performing an etch on the aluminum layer such as a sputter etch. This sputter etch removes accumulated oxidation (aluminum oxide). Though sputter etching gives good results for small surface areas, sputter etching does not give consistent coverage across the large surface areas required for current FEDs. For the above reasons, aluminum has significant disadvantages when used in forming row metal in prior art FED devices.

Accordingly, what is needed is a FED with row metal which minimizes signal delay and which meets signal propagation and other performance criteria and process compatibility criteria. In addition, a FED is needed which has row metal which is easy to deposit and etch and which can be formed using current processing techniques. Moreover, processing methods for forming a FED with row metal which has low resistivity and which forms a good bond with a resistive layer are required. Furthermore, processing methods are needed for forming a FED with row metal which is resistant to damage during subsequent processing steps. The present invention meets the above needs.

DISCLOSURE OF THE INVENTION

The present invention provides a field emission display (FED) which includes an improved cathodic structure. The cathodic structure includes row metal which is highly conductive. The row metal is formed using aluminum which is overlain by a thin cladding layer.

In one embodiment of the present invention, a faceplate is formed by depositing luminescent material within an active area surface formed on a glass plate. A cathodic structure is formed within an active area on a backplate. Walls are attached to either the faceplate or the backplate. A glass sealing material is placed within the border of the faceplate. The backplate is then placed over the faceplate such that the walls and the glass frit are disposed between the faceplate and the backplate. The assembly is then sealed by thermal processing and evacuation steps so as to form a complete FED.

The cathodic structure includes a row of metal strips aligned roughly parallel to each other (herein referred to as "row metal"). Each strip includes a layer of aluminum overlain by a layer of cladding material. A resistive layer overlies the row metal. A dielectric layer overlies the resistive layer. Column metal overlies the dielectric layer. Column metal is a row of strips of conductive material which are aligned roughly parallel to each other. Openings which extend through the column metal and through the dielectric layer expose portions of the resistive layer. Emitters are formed within the openings in the column metal and the dielectric layer such that they are electrically coupled to the resistive layer. In operation, electrical current is applied to one or more strips of the row metal and to one or more strips of column metal such that emitters disposed over the strips of row metal to which current is applied and within openings in the strips of column metal to which current is applied are engaged such that they emit electrons. These electrons strike the phosphor deposited on the faceplate so as to produce a visible display.

The use of aluminum and cladding material to form row metal gives row metal segments which are highly conductive due to the high conductivity of aluminum. By using processing steps and a cladding material which will not interdiffuse in subsequent thermal process steps, row metal is formed which maintains good electrical conductivity with overlying structures even after high temperature process steps. A cladding material which forms a good bond with the overlying resistive layer is used. In one embodiment, a refractory metal such as tantalum is used as a cladding material. When using silicon carbide to form the resistive layer a bond which has good electrical conductivity is formed between the tantalum layer and the silicon carbide. Thus, the resulting structure has very high electrical conductivity (through the aluminum layer) and high conductivity into the resistive layer.

In one embodiment, aluminum is deposited, masked and etched to form aluminum strips. A cladding layer of tantalum is then deposited over the aluminum strips. An etch is then performed so as to remove some or all of the tantalum between adjacent strips of aluminum and tantalum.

In an alternate embodiment, the aluminum and the cladding layer are deposited sequentially in a vacuum deposition chamber. The resulting structure is then masked and etched to form strips having aluminum overlain by the cladding layer. The sequential deposition process gives a more uniform cladding layer since oxidation between the aluminum layer and the cladding layer is avoided and since contamination that may occur from masking, etching, and photoresist removal steps is avoided.

The present invention produces a structure which has favorable conductivity characteristics and which has conductivity characteristics which are consistent throughout the row metal. In addition, as a result of the cladding layer's resistance to damage, the row metal is not damaged in process steps subsequent to the step of depositing the cladding layer.

The favorable conductivity characteristics are consistent throughout the row metal as a result of the cladding layer's resistance to damage in subsequent process steps. In particular, tantalum and other refractory metals resists damage when exposed to etchant chemicals and processing chemicals such as alkaline and acidic solutions which are commonly used in subsequent process steps. Aluminum is desirable as a conductor since it is commonly used in electronic circuit devices and because it is inexpensive and it has good conductivity.

These and other objects and advantages of the present invention will no doubt become obvious to those of ordinary skill in the art in light of the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

In one embodiment of the present invention, a faceplate which has one or more layers of phosphor deposited thereon is coupled to a backplate onto which a cathodic structure is formed. The cathodic structures includes emitters such as emitter 140 of FIG. 1I and emitter 340 of FIG. 3 which emit electrons that strike the phosphor layers on the faceplate so as to emit visible light and form a visible display.

Figure 1A:
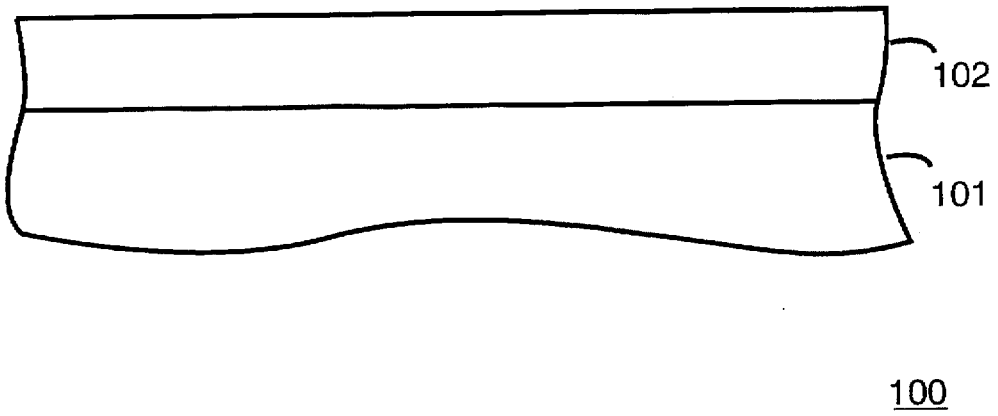
FIG. 1A is a side cross sectional view illustrating a step for depositing a layer of aluminum on a glass plate in accordance with the present claimed invention.
Figure 1B:
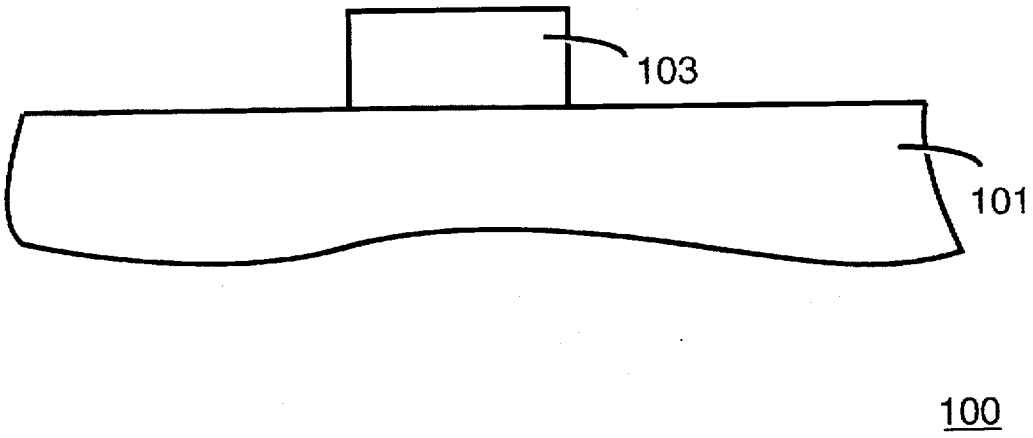
FIG. 1B is a side cross sectional view illustrating etching of an aluminum strip in accordance with the present claimed invention.
Figure 1C:
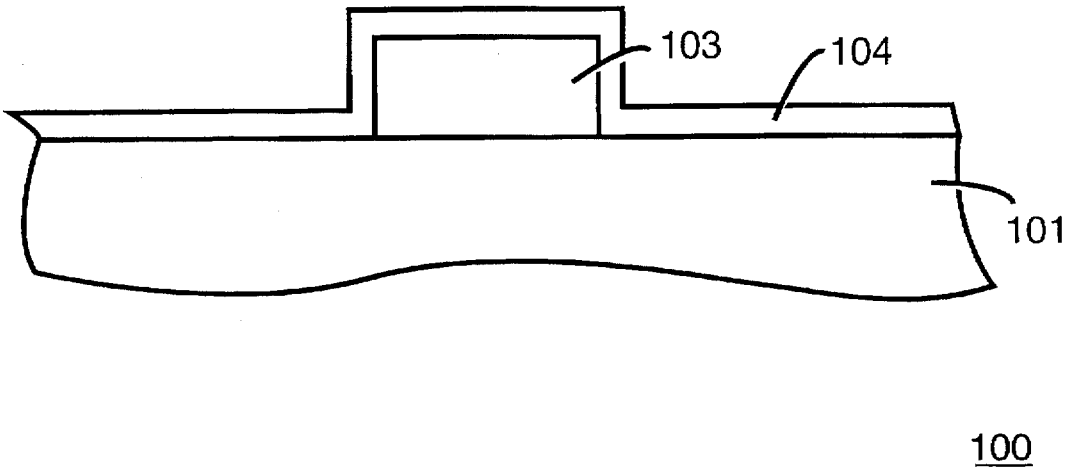
FIG. 1C is a side cross sectional view illustrating the deposition of a cladding layer in accordance with the present claimed invention.
Figure 1D:
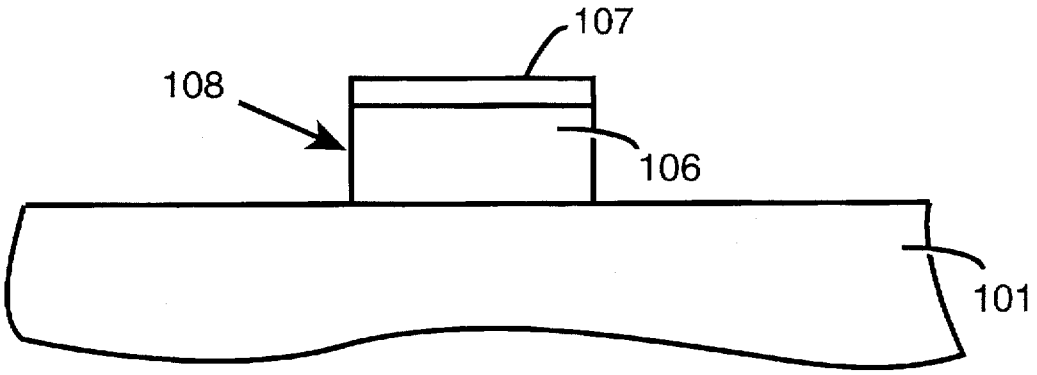
FIG. 1D is a side cross sectional view illustrating the structure of FIG. 1C after a mask and etch step in accordance with the present claimed invention.
Figure 1E:
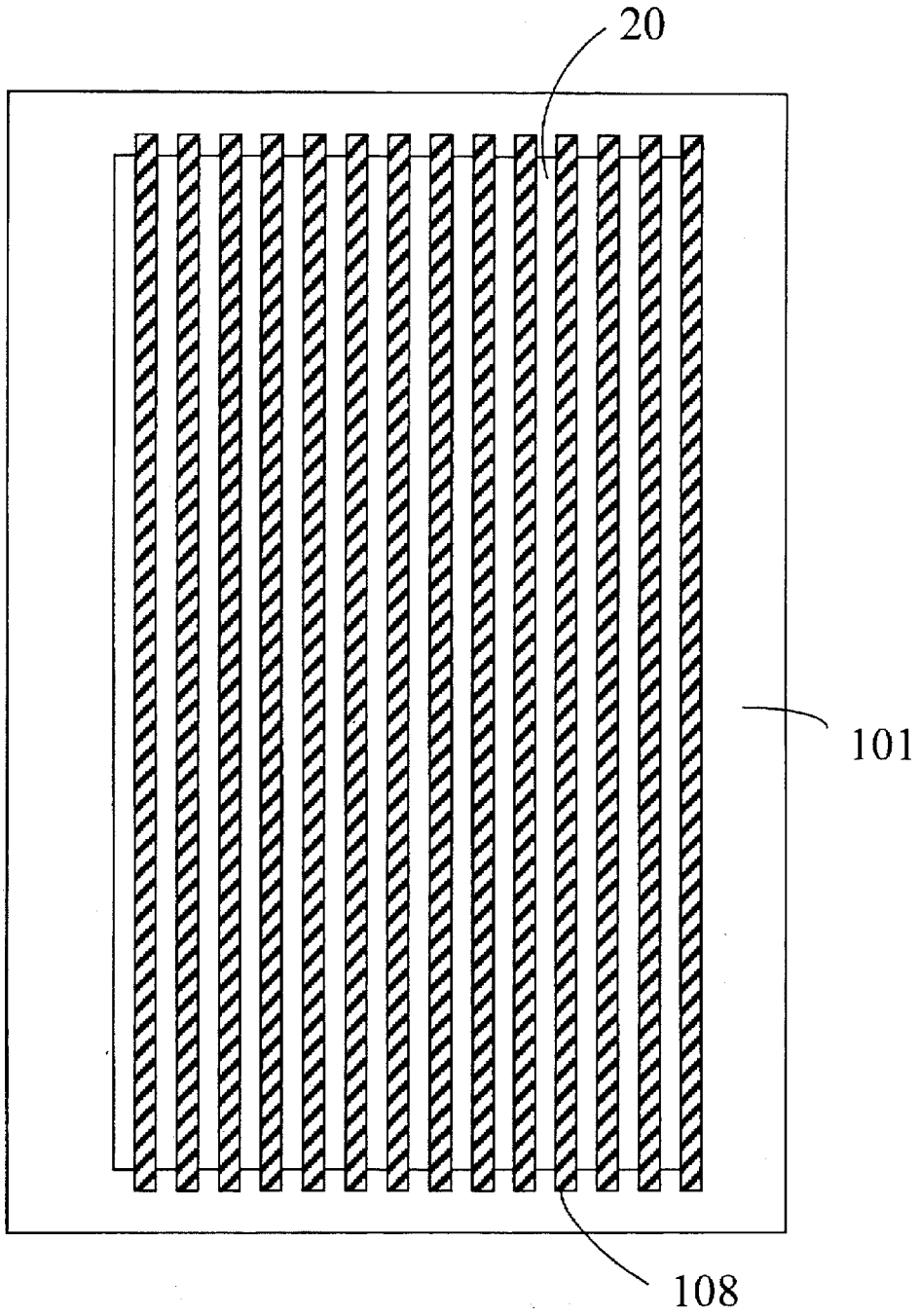
FIG. 1E is a top view illustrating row metal strips in accordance with the present claimed invention.
Figure 1F:
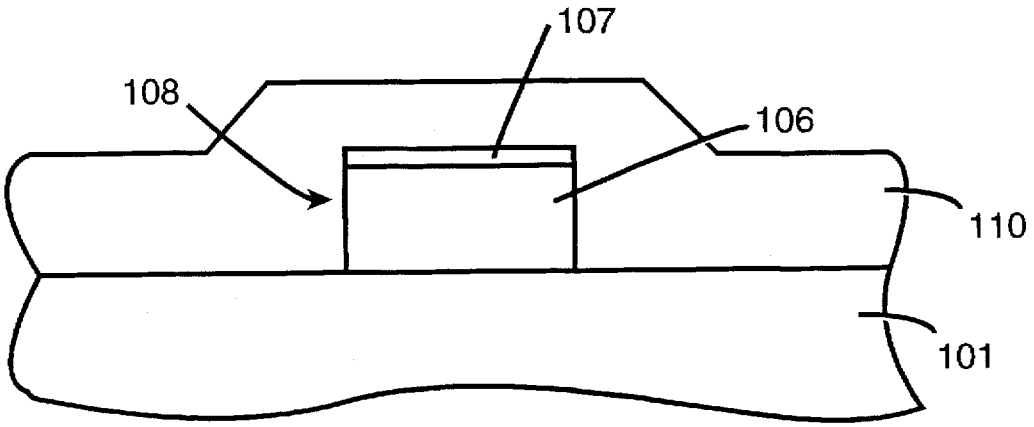
FIG. 1F is a side cross sectional view illustrating the deposition of a resistive layer in accordance with the present claimed invention.
Figure 1G:
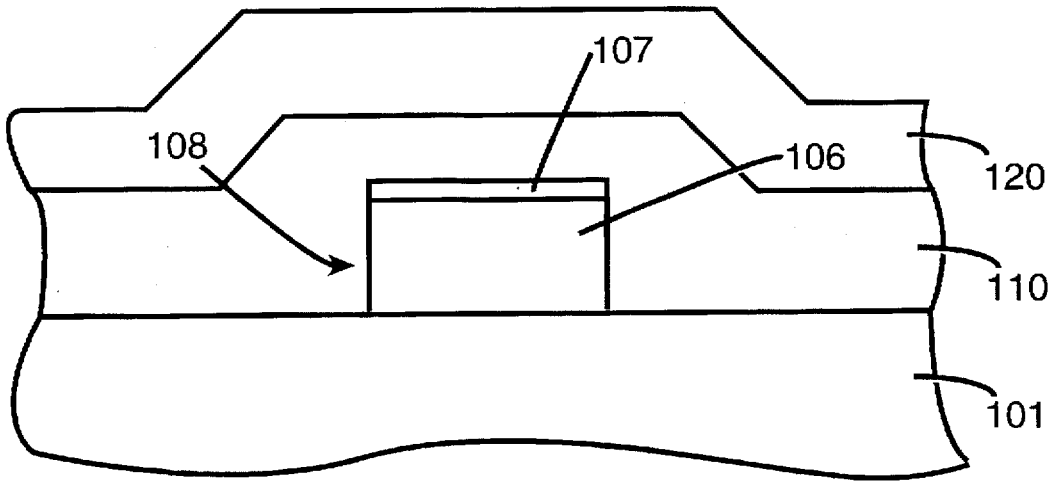
FIG. 1G is a side cross sectional view illustrating the deposition of a dielectric layer in accordance with the present claimed invention.
Figure 1H:
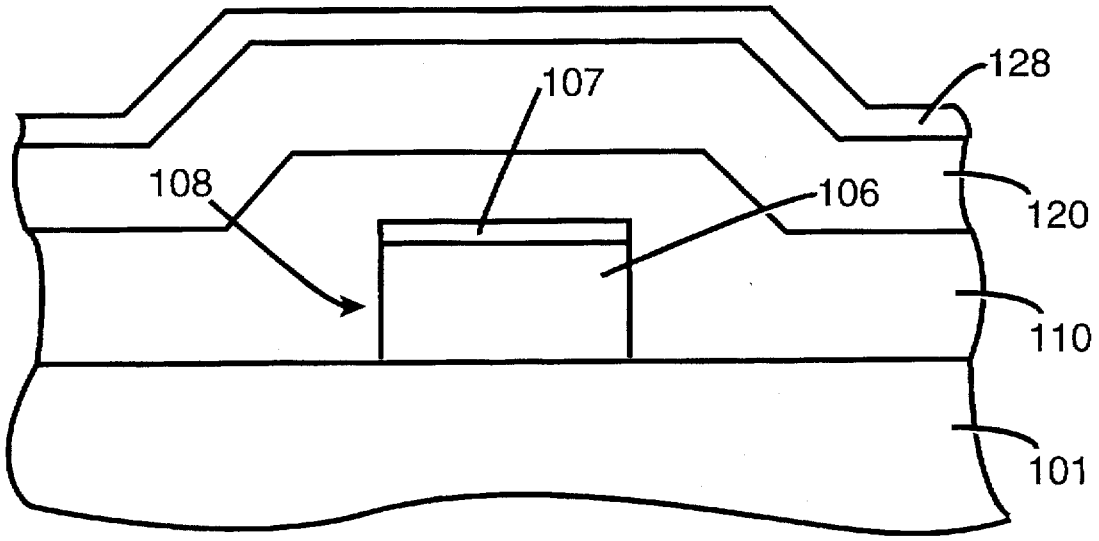
FIG. 1H is a side cross sectional view illustrating the deposition of a metal layer in accordance with the present claimed invention.
Figure 1I:
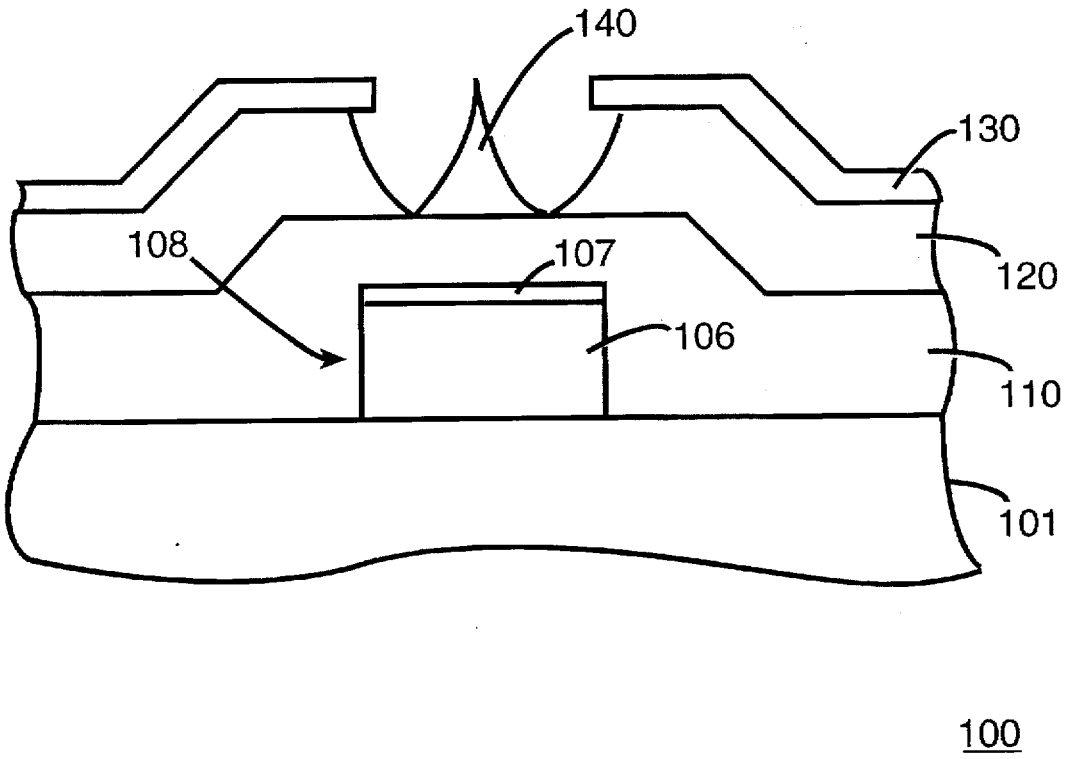
FIG. 1I is a side cross sectional view of the structure of FIG. 1H after mask and etch steps and emitter formation steps in accordance with the present claimed invention.

Backplate 100 of FIGS. 1A–1J includes a cathodic structure which includes row metal formed of a layer of aluminum over which a layer of cladding material is deposited. FIG. 2 shows a process 201 for forming a FED. With reference to step 210 of FIG. 2, backplate 100 is formed by first depositing an aluminum layer over the backplate 100. FIG. 1A shows backplate 100 which includes glass plate 101 over which aluminum layer 102 is deposited. In one embodiment, aluminum layer 102 is deposited by a sputter deposition process.

The aluminum layer is then masked and etched as shown by step 211 of FIG. 2. FIG. 1B shows the structure of FIG. 1A after mask and etch steps have etched aluminum layer 102 of FIG. 1A so as to form aluminum strip 103. If required, a cleaning step such as an ion cleaning step or a sputter etch may be used to clean the surface of the aluminum. In one embodiment, a sputter etch using an argon plasma is used to clean the surface of the aluminum.

A layer of cladding material is then deposited over backplate 100 as shown by step 212 of FIG. 2. FIG. 1C shows the structure of FIG. 1B after the deposition of cladding layer 104. In one embodiment, cladding layer 104 is deposited by a sputter deposition process. If required, a cleaning step such as an ion cleaning step or a sputter etch may be used to clean the surface of the aluminum prior to the step of depositing the cladding layer. In one embodiment, a sputter etch using an argon plasma is used to clean the surface of the aluminum. In one embodiment, cladding layer 104 is formed of a refractory metal. In one embodiment tantalum is used since it makes good electrical contact with overlying resistive layers and since it does not interdiffuse with aluminum. In addition, tantalum is compatible with all of the subsequent process steps and process chemicals which are typically used. In particular tantalum is resistant to process chemicals and is easy to process.

Mask and etch steps are then performed as shown by step 213 of FIG. 2. These mask and etch steps form row metal strips such as row metal strip 108 which extends across active area 20 as shown in FIG. 1E. With reference to FIG. 1D, the mask and etch steps remove the cladding material which overlies glass plate 101 and the cladding material which is deposited over the side surfaces of aluminum strip 106. This leaves cladding layer 107 which overlies aluminum strip 106 so as to form row metal strip 108. A wet etch could be used to etch both the cladding layer and the aluminum.

In one embodiment a reactive ion etch process is used to etch the aluminum and the cladding layer. In this embodiment, a first etch using flouring plasma is used to etch through the cladding layer. This etch stops on aluminum. The etch of the aluminum is then performed using a chlorine plasma. The etch is followed with a fluorine gas rinse to remove residual chlorine. In one embodiment, an etch process is used to yield a structure which has side surfaces that are sloped, rather than running vertically. FIG. 1K shows row metal strip 198 formed by etching aluminum layer 196 and cladding layer 197 using an etch process such that side surface 191 and side surface 192 are sloped. This structure allows for good step coverage of subsequent overlying layers. In addition, this structure is favorable for stress purposes, resulting in less damage to the cathodic structure upon subsequent thermal processing steps.

A resistive layer is then deposited as shown by step 214 of FIG. 2. In one embodiment, silicon carbide (SiC) is used as a resistor. FIG. 1F shows the structure of FIG. 1D after resistive layer 110 is deposited. Resistive layer 110 overlies row metal strip 108. In particular, resistive layer 110 overlies cladding layer 107 and surrounds the sides of aluminum layer 106. In one embodiment, resistive layer 110 is formed by depositing a first layer of silicon carbide having a thickness of approximately 2000 angstroms which is nitrogen doped to tailor it's resistivity to the requirements of the system. A thin layer of Cermet is then deposited over the SiC layer to complete the resistive layer. In one embodiment, the layer of Cermet has a thickness of approximately 500 angstroms. Cermet is a resistive material sold commercially by Pure Tech Incorporated of Carmel, N.Y. which is formed from silicon dioxide ($SiO_2$) and chromium (Cr).

The formation of the cathodic structure is then completed as shown in steps 218, 220, 222, and 224 of FIG. 2. In one embodiment, a dielectric layer is deposited over the resistive layer as shown by step 216 of FIG. 2. In one embodiment, a dielectric layer having a thickness of approximately 1500 angstroms is deposited. FIG. 1G shows the structure of FIG. 1F after dielectric layer 120 is deposited over resistive layer 110. In one embodiment, silicon dioxide is used to form dielectric layer 120.

Next, column metal is formed by depositing a layer of metal over the surface of backplate 100. In one embodiment, chromium is used to form column metal. FIG. 1H shows the structure of FIG. 1G after a layer of metal 128 is deposited. The layer of metal is then masked and etched as shown by step 220 of FIG. 2. Next, emitter openings are etched. Emitter openings may be etched by any of a number of known etch methods. In one embodiment, damage tracks are used to locate emitter openings which are then etched. Emitters are then formed within emitter openings as shown by step 224 of FIG. 2. FIG. 1I shows the structure of FIG. 1H after mask and etch steps have etched row metal strips, shown generally as row metal strip 130, after etching emitter openings, and after emitters, shown generally as emitter 140 are formed in backplate 100. Gates (not shown) and other required structures and circuits are also formed to complete the backplate.

Figure 1J:
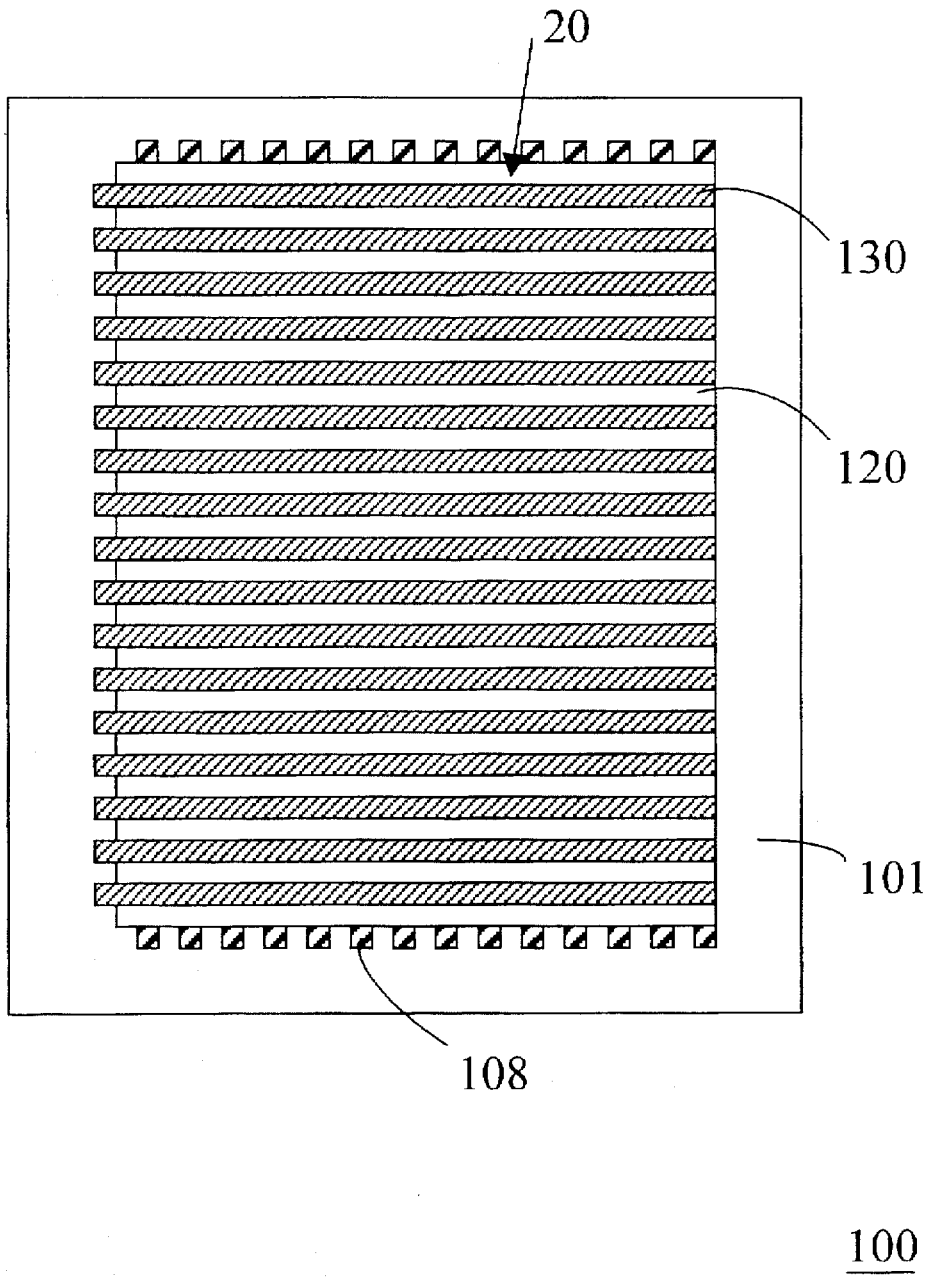
FIG. 1J is a top view illustrating a completed cathodic structure in accordance with the present claimed invention.
Figure 1K:
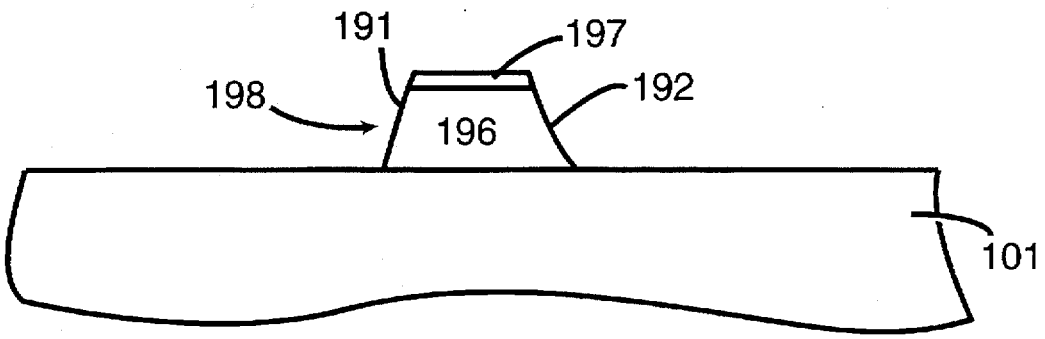
FIG. 1K is a side cross sectional view illustrating an embodiment having a favorable sidewall profile in accordance with the present claimed invention.
Figure 2:
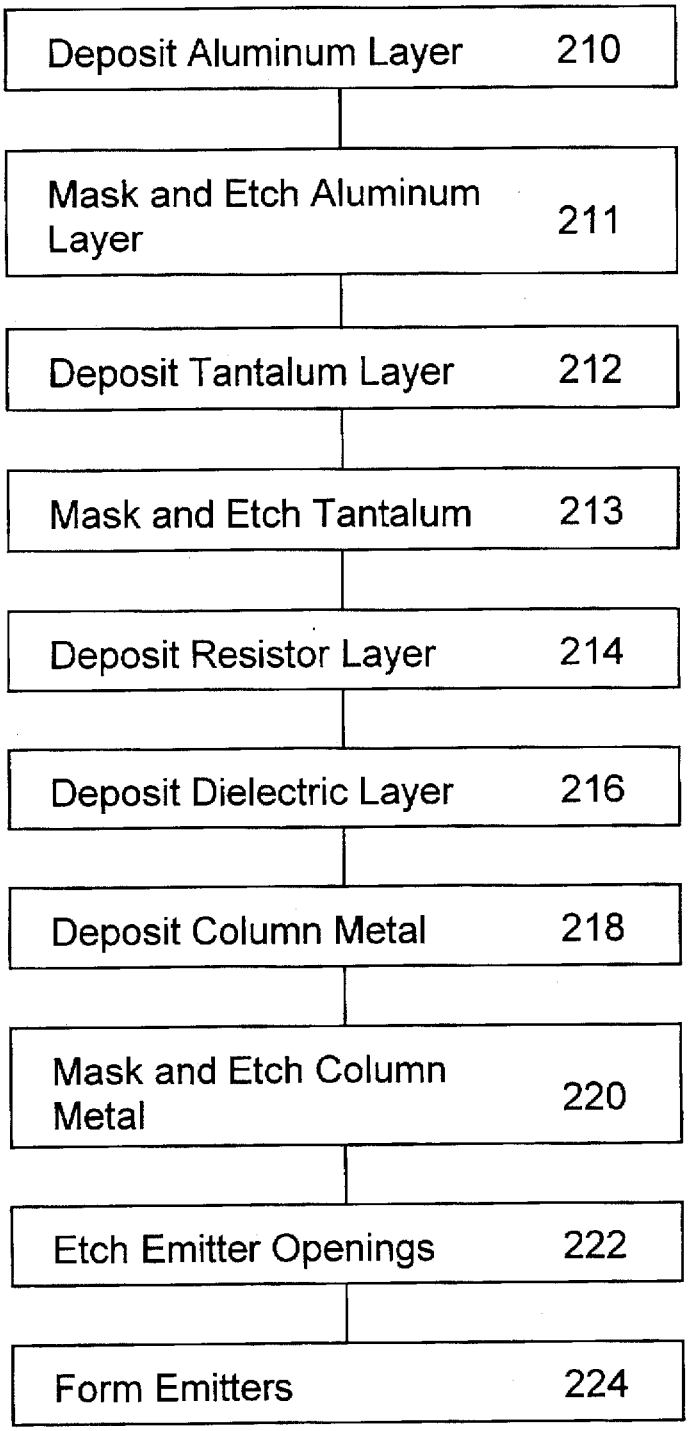
FIG. 2 is a diagram illustrating a method for forming a field emission display in accordance with the present claimed invention.

FIG. 1J shows backplate 100 after completion of steps 210–214, 216, 218, 220, 222, and 224 of FIG. 2 as shown in Figures 1A–1I. The completed cathodic structure formed over glass plate 101 includes column metal strips, shown generally as column metal strip 130. In one embodiment, column metal strips 130 have a thickness of approximately 1500 angstroms. Column metal strips, shown generally as column metal strip 130 extend out of active area 20 for connection to electronic circuits. Similarly, row metal strips, shown generally as row metal strip 108 extend out of active area 20 for connection to electronic circuits.

In an alternate embodiment the cladding layer overlies the sides of each aluminum strip. With reference to FIG. 2, an aluminum layer is deposited, as shown by step 210 of FIG. 2, and masked and etched, as shown by step 211. The photoresist used in the etch process is then stripped. The layer of cladding material is deposited, as shown by step 212 and the cladding layer is masked and etched as shown by step 213. However, the mask and etch steps only remove some or all of that portion of the cladding layer which overlies the glass plate between each aluminum strip (so as to prevent contact between aluminum strips). Thus the sides of each aluminum strip are not exposed. The resistor layer is then deposited over the cladding layer as shown by step 214. The dielectric layer is then deposited and column metal is masked and etched as shown by steps 216, 218 and 220. As shown by steps 222 and 224, emitter openings are etched and emitters are formed.

Figure 3:
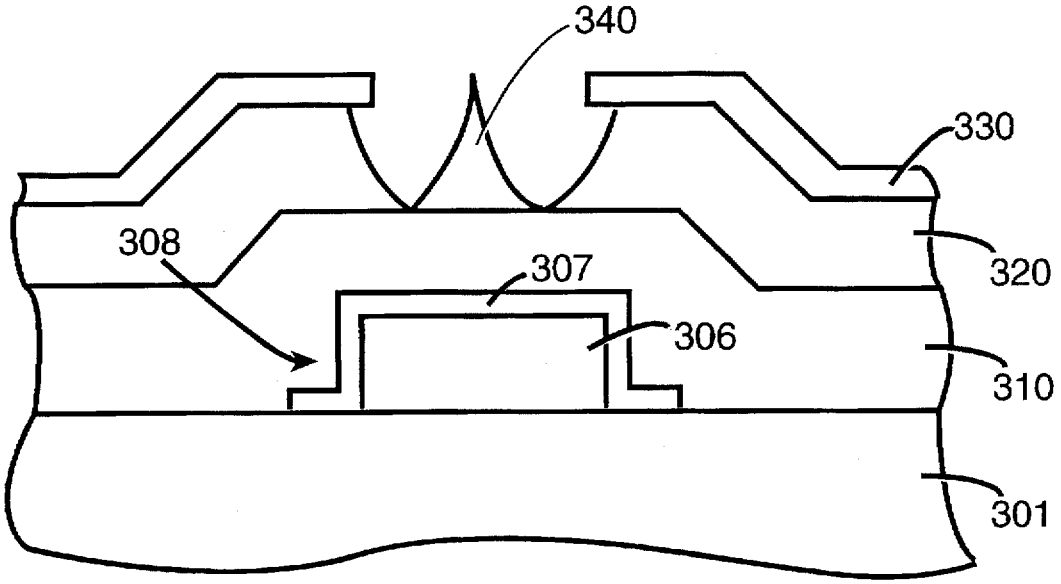
FIG. 3 is a cross sectional view illustrating a method for forming a field emission display in accordance with the present claimed invention.

FIG. 3 shows a backplate in which, cladding material is left overlying the top and sides of each of aluminum strip, shown generally as aluminum strip 306. Cladding, shown generally as cladding layer 307, seals each of aluminum strips 306 so as to form row metal strips shown generally as row metal strip 308. Since the sides of each aluminum strip 306 are sealed with cladding, the aluminum strip 306 is protected from damage in subsequent process steps.

Figure 4:
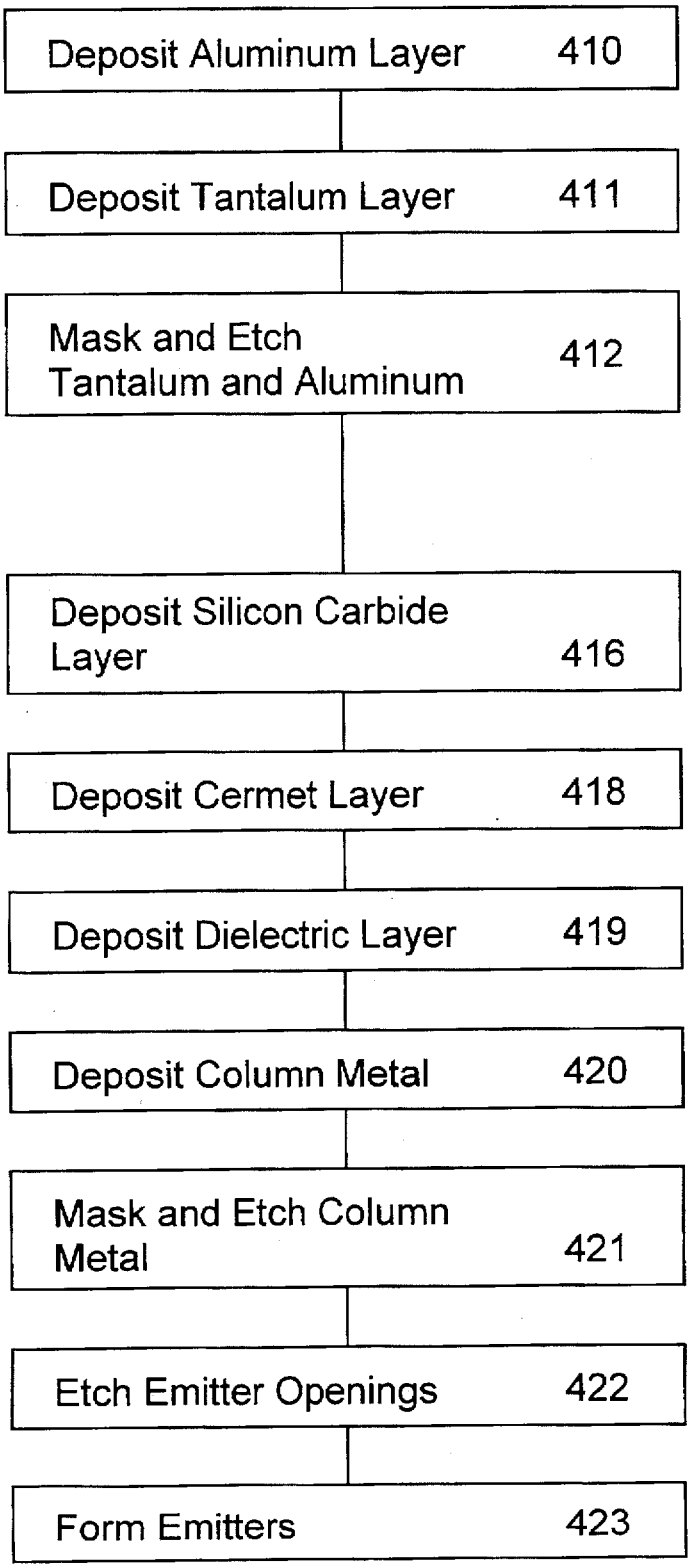
FIG. 4 is a diagram illustrating steps for forming a field emission display in accordance with the present claimed invention.

In one embodiment, deposition of aluminum and cladding material is performed sequentially. FIG. 4 shows a process for forming a FED using a sequential aluminum and cladding deposition process. As shown in FIG. 4, in this embodiment, an aluminum layer is deposited as shown by step 410 which is followed by a layer of cladding material as shown by step 411. In one embodiment this process is performed by sequentially depositing the aluminum layer and the cladding layer in a vacuum deposition chamber by sputter deposition methods. The sequential deposition of the aluminum and cladding layers prevents oxidation and contamination of the aluminum interface between the aluminum and cladding layers. The aluminum and cladding layers are then etched as shown by step 412. In one embodiment, when tantalum is used as a cladding material, a first etch using flourine plasma is used to etch through the cladding material. This etch stops on the aluminum layer. The aluminum layer is then etched using a chlorine plasma. The etch is followed with a fluorine gas rinse to remove residual chlorine. The photoresist mask is then removed. The resistor layer is then deposited as shown by steps 416 and 418. First a layer of silicon carbide is deposited as shown by step 416. Next, a layer of Cermet is deposited as shown by step 418. The structure is then completed by depositing a dielectric layer, depositing, masking and etching column metal, and etching emitter openings and forming emitters as shown by steps 419–423.

The use of tantalum as a cladding material prevents significant interdiffusion of the aluminum and tantalum. Even after the high temperature cycles in the fabrication process, there is little if any interdiffusion. Consequently there is no increase in the resistivity resulting from interdiffusion. This provides good horizontal and vertical electrical conductivity. The improved horizontal and vertical conductivity of the present invention reduces signal propagation delay and allows for the production of brighter displays having faster refresh rates.

Though the present invention is described with reference to the use of a refractive metal such as tantalum as a cladding material, any of a number of other materials could be used if those materials meet the criteria of easy to process, not interdiffusing with aluminum, make good electrical contact with the aluminum layer, make good electrical contact with the overlying resistor layer, and they are compatible with subsequent process steps and processing chemicals. Other refractory metals which may meet the above requirements include molybdenum, tungsten, and titanium. In addition to tantalum, other materials which may meet the above requirements include niobium, nickel, chromium, metal silicides, and composite films such as tantalum nitride, titanium-tungsten, and metal silicides.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

We claim:

1. A field emission display including a faceplate having an active area surface and a cathodic structure formed on a backplate, said cathodic structure comprising:

a first metal layer disposed over said backplate in a plurality of rows, said first metal layer formed of aluminum so as to enhance conductivity throughout said first metal layer;

a cladding layer disposed over said first metal layer such that said first metal layer and said cladding layer form a plurality of rows of metal, said cladding layer formed of an electrically conductive material and electrically coupled to said first metal layer;

a resistive layer formed over said cladding layer and electrically coupled to said cladding layer; and a plurality of emitters electrically coupled to said resistive layer such that, upon the application of power to said first metal layer and said cladding layer, electrical current selectively flows through said resistive layer and selectively engages said emitters generate electrons which are for striking said active area of said faceplate to generate a visible display.

2. The field emission display of claim 1 wherein said cathodic structure further comprises:

a dielectric layer deposited over said backplate such that said dielectric layer overlies said resistive layer, said dielectric layer having openings formed therein;

a second metal layer disposed over said dielectric layer in a plurality of columns, said second metal layer having a plurality of openings formed therein; and wherein said emitters are disposed within openings which extend through said dielectric layer and which extend through said second metal layer such that, upon the application of power to ones of said rows of metal, and upon the application of power to ones of said columns of said second metal layer, electricity selectively flows from said rows of metal to said emitters such that said emitters emit electrons for generating a display.

3. The field emission display of claim 1 wherein said resistive layer further comprises:

a layer of silicon carbide disposed over said cladding layer, said layer of silicon carbide electrically coupled to said cladding layer so as to allow electrical current to flow from said cladding layer into said layer of silicon carbide; and a layer of cermet disposed over said layer of silicon carbide, said layer of cermet electrically coupled to said layer of silicon carbide so as to allow electrical current to flow from said layer of silicon carbide into said layer of cermet, said emitters disposed over said layer of cermet such that, upon the application of electrical current to said rows of metal, said electrical current flows into said emitters so as to selectively engage said emitters.

4. The field emission display of claim 3 wherein said first metal layer includes a top surface and side surfaces and wherein said cladding layer is disposed over said first metal layer such that said cladding layer overlies said top surface and said side surfaces of said first metal layer.

5. The field emission display of claim 1 wherein said first metal layer includes a top surface and side surfaces and wherein said side surfaces are sloped.

6. The field emission display of claim 1 wherein said first metal layer and said cladding layer are formed using a sequential deposition process in a vacuum filled chamber.

7. The field emission display of claim 1 wherein said cladding layer is selected from the group consisting of tantalum, tungsten, molybdenum, titanium, niobium, nickel, chromium, tantalum nitride, titanium-tungsten, and metal silicides.

8. The field emission display of claim 1 wherein said cladding layer comprises a refractory metal.

9. The field emission display of claim 1 wherein said cladding layer comprises tantalum.

* * * * *

UNITED STATES PATENT AND TRADEMARK OFFICE
CERTIFICATE OF CORRECTION

PATENT NO : 5,894,188

DATED : April 13, 1999

INVENTOR(S) : Kishore K. Chakravorty and Swayambu Ramani

It is certified that error appears in the above-identified patent and that said Letters Patent are hereby corrected as shown below:

On Issued Patent 5,894,188 Chakvorty et al. should read Chakravorty et al. and Inventors should read Kishore K. Chakravorty; Swayambu Ramani, both of San Jose, Calif.

Signed and Sealed this

Eighth Day of February, 2000

*Attest:*

Q. TODD DICKINSON

*Attesting Officer*

*Commissioner of Patents and Trademarks*